US009864324B2

(12) United States Patent
Suzuki

(10) Patent No.: US 9,864,324 B2
(45) Date of Patent: Jan. 9, 2018

(54) IMAGE FORMING APPARATUS

(71) Applicants: KABUSHIKI KAISHA TOSHIBA, Tokyo (JP); TOSHIBA TEC KABUSHIKI KAISHA, Tokyo (JP)

(72) Inventor: Yasushi Suzuki, Numazu Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/358,167

(22) Filed: Nov. 22, 2016

(65) Prior Publication Data

US 2017/0123369 A1 May 4, 2017

Related U.S. Application Data

(63) Continuation of application No. 15/008,010, filed on Jan. 27, 2016, now Pat. No. 9,535,377, which is a continuation of application No. 14/621,670, filed on Feb. 13, 2015, now Pat. No. 9,280,096.

(30) Foreign Application Priority Data

Apr. 25, 2014 (JP) ..... 2014-091776

(51) Int. Cl.
*G03G 21/16* (2006.01)

(52) U.S. Cl.
CPC . *G03G 21/1633* (2013.01); *G03G 2221/1654* (2013.01)

(58) Field of Classification Search
CPC combination set(s) only.
See application file for complete search history.

(56) References Cited

U.S. PATENT DOCUMENTS

| | | | | |
|---|---|---|---|---|
| 6,665,507 | B1 | 12/2003 | Hooper, III et al. | |
| 8,922,799 | B2 | 12/2014 | Ito | |
| 9,280,096 | B2 | 3/2016 | Suzuki | |
| 9,535,377 | B2 * | 1/2017 | Suzuki | G03G 15/16 |
| 2001/0028814 | A1 | 10/2001 | Oba et al. | |
| 2002/0041775 | A1 * | 4/2002 | Ishii | G03G 15/80 399/124 |
| 2006/0072937 | A1 | 4/2006 | Hymas et al. | |
| 2010/0129101 | A1 * | 5/2010 | Muto | G03G 21/1857 399/53 |
| 2012/0321360 | A1 | 12/2012 | Futamata et al. | |

* cited by examiner

*Primary Examiner* — Clayton E Laballe
*Assistant Examiner* — Jas Sanghera
(74) *Attorney, Agent, or Firm* — Patterson & Sheridan, LLP

(57) ABSTRACT

According to an embodiment, an image forming apparatus includes a case having a door which can be opened and closed. A first rotating body, provided in the case, is exposed from the case when the door is opened. A second rotating body, provided in the case, is exposed from the case when the door is opened. The second rotating body forms a nip with the first rotating body. A spacer, detachably provided in the case, separates the first rotating body and the second rotating body when the spacer is attached. The second rotating body forms a nip with the first rotating body when the spacer is detached.

13 Claims, 9 Drawing Sheets

IMAGE FORMING APPARATUS

CROSS-REFERENCE TO RELATED APPLICATIONS

This application is a continuation of U.S. patent application Ser. No. 15/008,010, filed on Jan. 27, 2016, which is a continuation of U.S. patent application Ser. No. 14/621,670, filed on Feb. 13, 2015, now U.S. Pat. No. 9,280,096, issued on Mar. 8, 2016, which is based upon and claims the benefit of priority from the prior Japanese Patent Application No. 2014-091776, filed on Apr. 25, 2014, the entire contents of each of which are incorporated herein by reference.

FIELD

Embodiments described herein relate generally to an image forming apparatus to form an image using toner fixable at low temperature.

BACKGROUND

Recently, an image forming apparatus, such as a copying machine, which can use toner which is decolorable for reuse of paper, and fixable at low temperature (hereinafter, called low temperature toner) has been developed. This low temperature toner is fixed at a fixing temperature of about 50° C. Accordingly, an image forming apparatus capable of using the low temperature toner can form an image at a temperature lower than a decoloring temperature for decoloring characters and an image.

However, in the above-described image forming apparatus, a trouble caused by using low temperature toner is also thought. For example, when the image forming apparatus is transported by shipping for a long term, at the time of shipment of the image forming apparatus, there may be a case that an ambient temperature of the image forming apparatus exceeds a fixing temperature of the low temperature toner. In a test printing before shipment of the image forming apparatus, the low temperature toner is supplied between a photoconductor drum and a transfer roller of the image forming apparatus. Accordingly, when the ambient temperature of the image forming apparatus exceeds the fixing temperature, there may be a case that the low temperature toner remaining between the photoconductor drum and the transfer roller melts, and firmly adheres to the photoconductor drum. The low temperature toner adhered firmly to the photoconductor drum may become a cause of image failure at the time of using the image forming apparatus.

Accordingly, development of an image forming apparatus capable of using low temperature toner which can form a good image, even when the ambient temperature of the image forming apparatus rises as described above, has been desired.

DETAILED DESCRIPTION

According to one embodiment, an image forming apparatus has an image carrier, a conveying unit, a transfer unit, and a spacer. The image carrier has an image carrying surface on which an image by low temperature toner is formed. The conveying unit conveys a recording medium to the image carrier. The transfer unit is provided in the conveying unit, forms a nip with the image carrying surface, and transfers the image by the low temperature toner from the image carrying surface to the recording medium. The spacer is detachably provided on the transfer unit, and makes the image carrier and the transfer unit to be separated.

Figure 1:
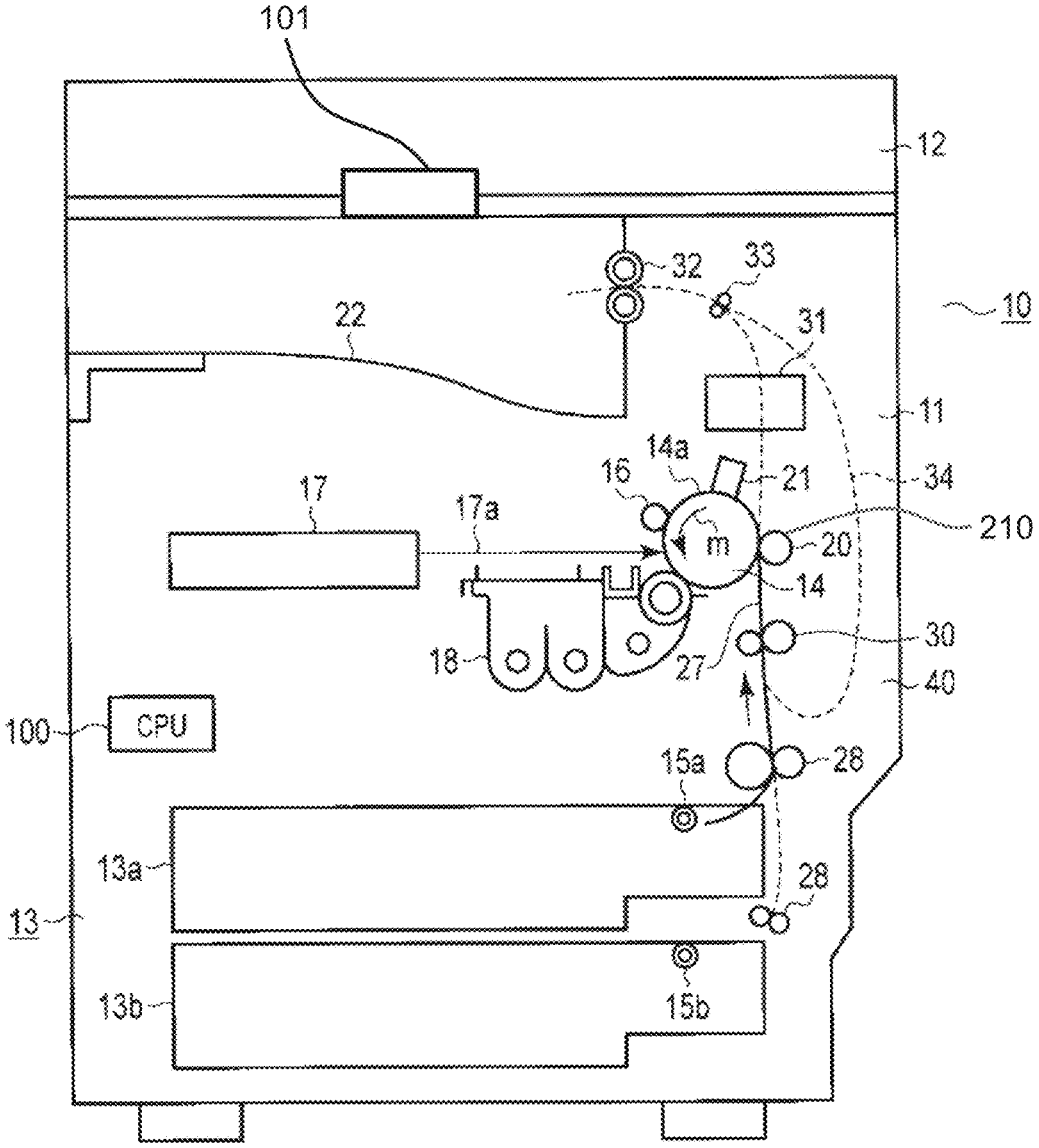
FIG. 1 is a sectional view showing a main portion of an image forming apparatus according to a first embodiment.

Hereinafter, further embodiments will be described with reference to the drawings. In the drawings, the same symbols show the same or similar portions. An image forming apparatus according to a first embodiment will be described with reference to FIG. 1. FIG. 1 is a sectional view showing a main portion of an image forming apparatus according to a first embodiment. The image forming apparatus shown in FIG. 1 is an MFP (Multi Function Peripheral) 10. The MFP 10 has a printer unit 11, a scanner unit 12, a sheet feeding unit 13, a sheet discharge unit 22. Further, the MFP 10 has a conveying unit 40 and a CPU (Central Processing Unit) 100. The conveying unit 40 is provided between the sheet feeding unit 13 and the sheet discharge unit 22. The conveying unit 40 conveys a sheet P that is a recording medium to a photoconductor drum 14 described later that is an image carrier. The CPU 100 controls the whole of the MFP 10.

The sheet feeding unit 13 has first and second sheet feeding cassettes 13*a*, 13*b*. The first and second sheet feeding cassettes 13*a*, 13*b* respectively house an unused sheet of a prescribed size, and a reuse sheet of a prescribed size which are recording mediums. The sheet feeding unit 13 further has sheet feeding rollers 15*a*, 15*b*. The sheet feeding rollers 15*a*, 15*b* which are respectively provided in the first and second sheet feeding cassette 13*a*, 13*b* take out sheets one by one from the first and second sheet feeding cassettes 13*a*, 13*b*, and convey the taken out sheets to a conveying path 27 described later, respectively.

The printer unit 11 uses an electrophotographic system as a printing system. Specifically, the printer unit 11 has the photoconductor drum 14, a charger 16, and a laser exposure device 17. The photoconductor drum 14 is an image carrier which rotates in the direction of an arrow m, while carrying an image by toner. The photoconductor drum 14 has a photosurface 14*a*, as an image carrying surface which carries the image by toner. The photosurface 14*a* has an image forming region with a prescribed width where the image by toner is formed. The charger 16 uniformly charges the inside of the image forming region of the photosurface 14*a*. In the following description, the image forming region of the photosurface 14*a* which is charged by the charger 16 is called a charging region. The laser exposing device 17 irradiates the photosurface 14*a* after charging with laser light 17*a* based on the image data from the scanner unit 12 and so on. The laser exposing device 17 irradiates the laser light 17*a*, to expose the photosurface 14*a* of the photoconductor drum 14, and thereby forms an electrostatic latent image on the photosurface 14*a*.

Further, the printer unit 11 has a developing device 18, a transfer unit 20, and a cleaner 21. The developing device 18 supplies toner to the electrostatic latent image formed on the photosurface 14*a* of the photoconductor drum 14, to develop the electrostatic latent image. The developing device 18 develops the electrostatic latent image, to form an image by toner on the photosurface 14*a* of the photoconductor drum 14. In the following description, an image by toner is called a toner image. The transfer unit 20 has a transfer roller 210 (refer to FIG. 1, FIG. 8, FIG. 9, for example). The transfer roller 210 makes contact with the photosurface 14*a*, in the state that a spacer 1 described later is not fitted to a contact roller 201 described later. The transfer roller 210 makes contact with the photosurface 14*a*, to form a nip with the photosurface 14*a*. The transfer unit 20 transfers the toner image formed on the photosurface 14*a* to the sheet P at the position of this nip. The position of the nip is called a transfer position. The cleaner removes the toner from the photosurface 14*a* of the photoconductor drum 14 after the toner image has been transferred, to clean the photosurface 14*a*.

The above-described developing device 18 houses two-component developer that is a mixture of toner and magnetic carrier, for example, and supplies the toner to the electrostatic latent image formed on the photosurface 14*a* of the photoconductor drum 14, as described above. The toner is toner fixable at low temperature that can be fixed at a relatively low temperature of about 50° C. In the following description, the toner fixable at low temperature is called low temperature toner.

The printer unit 11 further has a fixing device 31. The fixing device 31 heats the toner image transferred to the sheet P, to melt and fix the toner image to the sheet P. The MFP 10 has the conveying path 27. The conveying path 27 is formed between from the sheet feeding unit 13 to the sheet discharge unit 22, via the transfer position by the above-described transfer unit 20, and the fixing device 31. The conveying path guides the sheet P to be conveyed, from the sheet feeding unit 13 to the sheet discharge unit 22, via the transfer position by the above-described transfer unit 20, and the fixing device 31.

The printer unit 11 further has a plurality of conveying rollers 28, a resist roller pair 30, a sheet discharge roller 32, a reversing roller 33, and a reverse conveying path 34. The conveying rollers 28, the resist roller pair 30, and the sheet discharge roller 32 are provided along the conveying path 27. The reversing roller 33 is provided at a position of the upstream side of the sheet discharge roller 32 and the downstream side of the fixing device 31.

The plurality of conveying rollers 28 convey the sheet P which has been fed by each of the first and second sheet feeding rollers 15*a*, 15*b* to the resist roller pair 30. The resist roller pair 30 conveys the sheet P to the transfer position by the above-described transfer unit 20, in synchronization with that the toner image is formed on the photoconductor drum 14. The sheet discharge roller 32 and the reversing roller 33 are rotatable in the forward and reverse directions. In the case of single-sided print wherein an image is formed on only one surface of the sheet P, the sheet discharge roller 32 and the reversing roller 33 rotate in the forward direction. The sheet discharge roller 32 discharges the sheet P after fixing to the sheet discharge unit 22, in cooperation with the reversing roller 33. In the case of both-sided print wherein images are formed on the both surfaces of the sheet P, the sheet discharge roller 32 and the reversing roller 33 once rotate in the forward direction, and then rotate in the reverse direction. The reversing roller 33 sends the sheet P after fixing to the reverse conveying path 34, in cooperation with the sheet discharge roller 32. The reverse conveying path 34 is formed such that it branches from the conveying path 27 at the upstream side of the reversing roller 33, and merges into the conveying path 27 at the upstream side of the resist roller pair 30. The reversing roller 33 reverses the conveying direction of the sheet P, to reverse the front and back surfaces of the sheet P. The reversing roller 33 returns the sheet P whose front and back surfaces have been reversed, to the position of the upstream side of the resist roller pair 30 in the conveying path 27, via the reverse conveying path 34.

With the above-described configuration, the MFP 10 transfers the toner image formed by the printer unit 11, to the sheet P fed from the sheet feeding unit 13. The MFP 10 fixes the toner image of the sheet P to the sheet P by the fixing device 31, and discharges the sheet P after fixing to the sheet discharge unit 22. The printing system of the printer unit 11 is not limited to the above-described electrophotographic system, but may be an ink jet system or the like.

Figure 2:
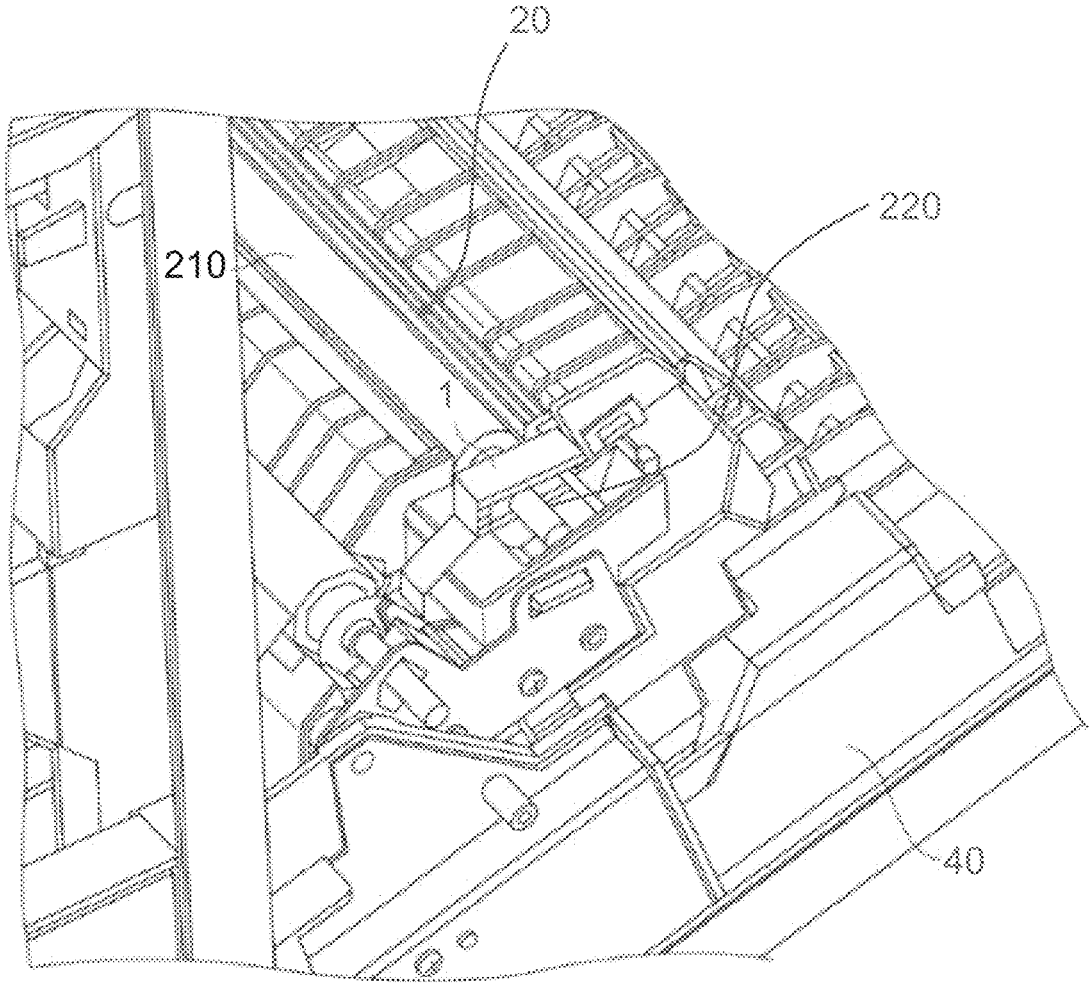
FIG. 2 is a perspective view showing a sheet conveying unit, in the state that the conveying unit doubling as a side face cover of the image forming apparatus according to the first embodiment is opened.

Hereinafter, the conveying unit 40 will be described with reference to FIG. 2. FIG. 2 is a perspective view showing the conveying unit 40 in the state that a side face cover of the MFP is opened. The conveying unit 40 is provided openably and closably for a main body of the MFP 10, and doubles as the side face cover of the MFP 10. When the conveying unit 40 is opened as shown in FIG. 2, one side of the above-described conveying path 27 is exposed. The conveying unit 40 includes the other side of the conveying path 27, the above-described transfer unit 20, and the above-described reverse conveying path 34, and so on.

The low temperature toner is fixed to the sheet P at a fixing temperature of about 50° C., as described above. For example, the low temperature toner may contain special coloring material whose color is erased by being added with heat of a temperature higher than the fixing temperature (about 50° C.)

On the other hand, a sheet feeding test is performed for the MFP 10 before shipment. The sheet feeding test includes a sheet feeding test in the case of both-sided print. In the case of both-sided print, the sheet P with a test image formed on one surface (a front surface, for example) is reversed by the reversing roller 33, and the reversed sheet P is fed again to the conveying path 27, and a test image is formed on the other surface (back surface). When the test image is formed on the other surface, one surface of the sheet P after the test image has been formed makes contacts with the transfer roller 210 of the transfer unit 20. Accordingly, after the sheet feeding test, the toner slightly remains on the surface of the transfer roller 210 of the transfer unit 20.

The MFP 10 further has an operation panel 101 (refer to FIG. 1). The operation panel 101 includes a size designation unit to accept designation of a size of the sheet P used for image forming. The above-described sheet feeding unit 13 of the MFP 10 includes a manual feed tray which is not shown and is used in place of the above-described first and second sheet feeding cassettes 13*a*, 13*b*. For example, in the sheet feeding test in the case that the sheet P is fed from the manual feed tray, the size of the sheet P is designated to "non-size (a sheet size is not designated)" from the operation panel 101, and the sheet feeding test is performed. In the case of non-size, the MFP 10 charges the charging region of the photosurface 14*a*, in accordance with the maximum usable sheet size (A3 size, for example) of the MFP 10, regardless of the size of the sheet P to be actually fed, and forms the test image. When the size of the sheet P to be actually fed is smaller than the A3 size, the photoconductor drum 14 faces the transfer roller of the transfer unit 20, at a charging region (hereinafter, called a charging region outside sheet size) of a region exceeding the size of the relevant sheet. On the other hand, in the charging region, toner is electrostatically drawn from the developing device 18, and adheres to the charging region. Accordingly, when the test image (toner image) formed on the photoconductor drum 14 is transferred to the sheet P, the toner adhering to the above-described charging region outside sheet size moves to the transfer roller of the transfer unit 20, and adheres to the surface of the transfer roller.

Further, in the MFP 10, the above-described charging region of the photoconductor drum 14 is previously set larger than the sheet size of the sheet P which has been designated from the above-described operation panel 101. Accordingly, even when the size of the sheet P designated from the operation panel and the size of the sheet P to be actually fed are the same, the MFP 10 charges the charging region larger than the size of the sheet P on the photoconductor drum 14, and forms the test image. Accordingly, as described above, the above-described charging region outside sheet size of the photoconductor drum 14 faces the transfer roller of the transfer unit 20. Further, in the charging region, the toner is electrically drawn from the developing device 18, and adheres to the charging region. Accordingly, when the test image formed on the photoconductor drum 14 is transferred to the sheet P, the toner adhering to the above-described charging region outside sheet size moves to the transfer roller of the transfer unit 20, and adheres to the surface of the transfer roller. Accordingly, the transfer roller of the transfer unit 20 becomes in the state that the toner adheres to and remains on the surface, after the sheet feeding test.

On the other hand, at the time of normal using, the MFP 1 is energized, to periodically clean the surface of the photoconductor drum 14. At the time of this cleaning, the toner remaining on the transfer roller of the transfer unit 20 moves to the photoconductor drum 14, and thereby the transfer roller is cleaned.

However, at the time of shipment of the MFP 10, the MFP 10 is not in the environment that the MFP 10 is energized for periodically cleaning the photoconductor drum 14. Accordingly, the low temperature toner remaining on the transfer roller 20 as a result of the above-described test print is exposed to a temperature higher than the fixing temperature, in such a case that the MFP 10 is transported for a long term by shipping, for example, there is a possibility that the low temperature toner has firmly adhered to the photoconductor drum 14.

The trouble that the low temperature toner has firmly adhered to the photoconductor drum 14 can occur similarly in a color image forming apparatus which uses a transfer belt or a secondary transfer belt as the transfer unit. For example, when a color image is formed using a transfer belt, a monochrome toner image formed on the photoconductor drum is transferred to the transfer belt in an overlapped manner. In the case of this transfer, the toner slightly adheres to the transfer belt facing the above-described charging region outside sheet size in the image forming region of the photosurface 14*a*, and remains therein.

In order to prevent the trouble that the low temperature toner has firmly adhered to the photoconductor drum 14, the MFP 10 has a spacer 1. The spacer 1 has a structure in which the spacer 1 can be detachably attached to the conveying unit 40 as described later. When attached to the conveying unit 40, the spacer 1 makes the transfer roller of the transfer unit 20 and the photoconductor drum 14 to be separated from each other. The spacer 1 is attached to the conveying unit 40 at the time of shipment of the MFP 10.

Figure 3:
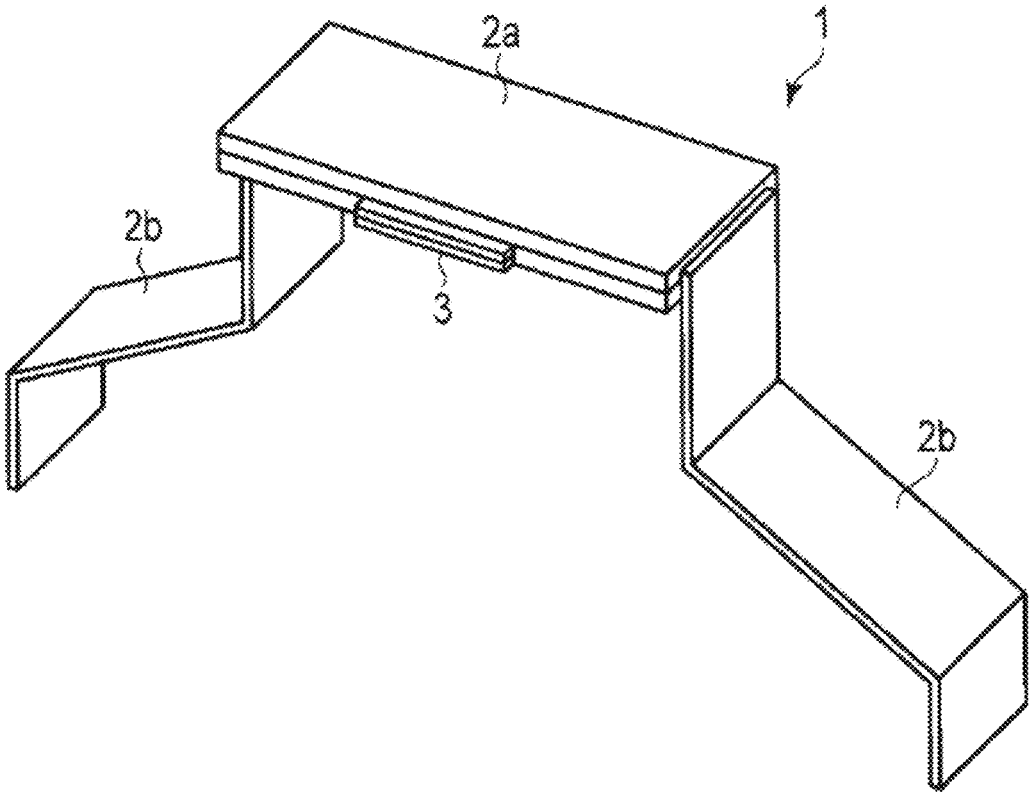
FIG. 3 is a perspective view showing a spacer to be attached to the conveying unit of the image forming apparatus according to the first embodiment.
Figure 4:
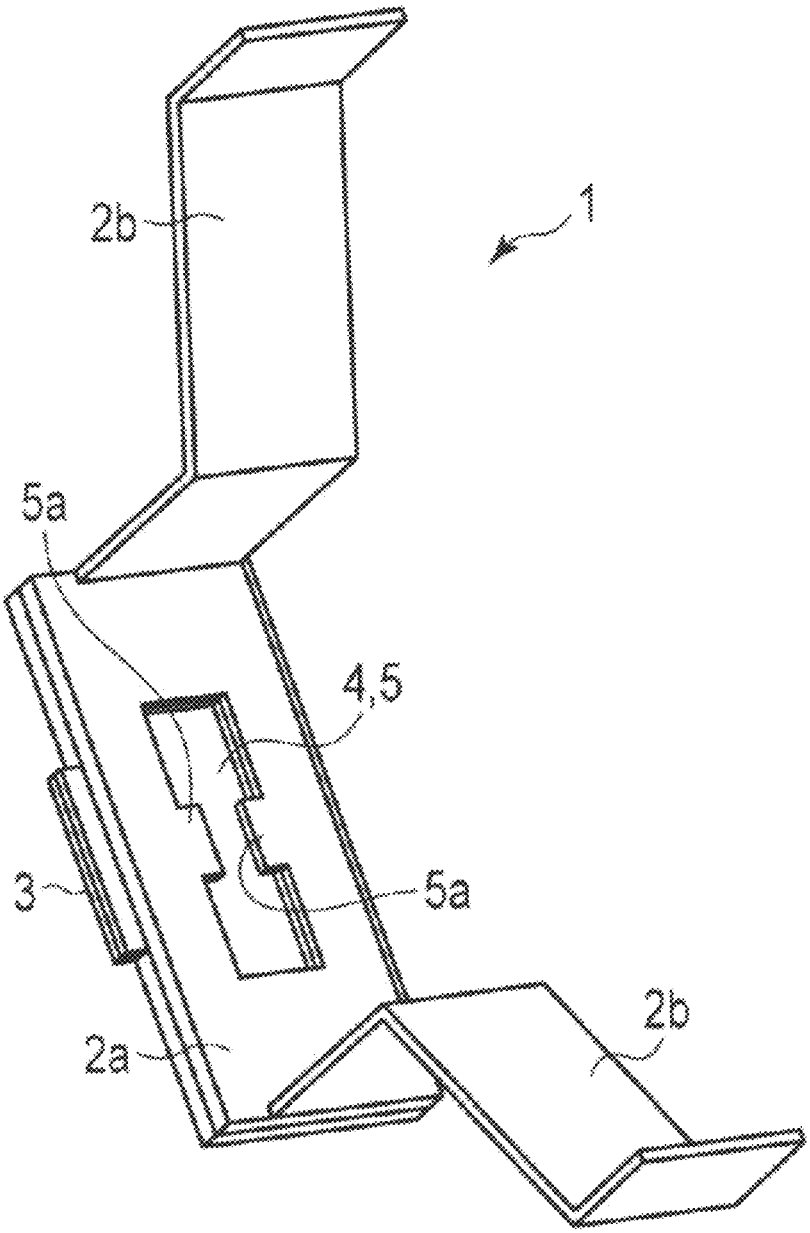
FIG. 4 is a perspective view showing a back side of the spacer to be attached to the conveying unit of the image forming apparatus according to the first embodiment.
Figure 5:
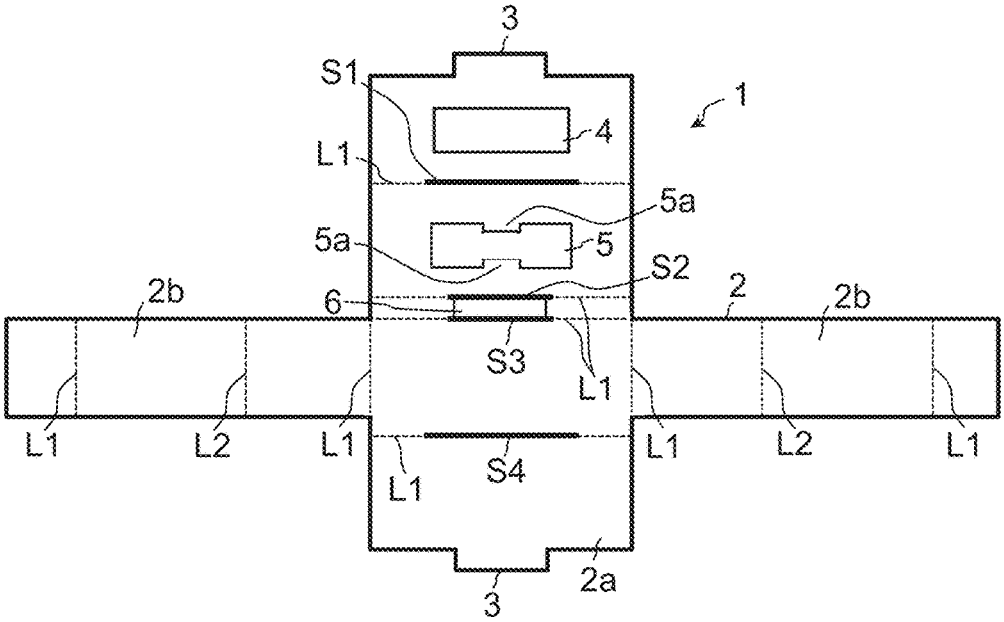
FIG. 5 is a plan view showing a state in which the spacer to be attached to the conveying unit of the image forming apparatus according to the first embodiment is expanded.

The spacer 1 will be described with reference to FIG. 3, FIG. 4, and FIG. 5. FIG. 3 is a perspective view of the spacer 1. FIG. 4 is a perspective view showing a back surface side of the spacer 1 shown in FIG. 3. FIG. 5 is a view showing the developed spacer 1. The spacer 1 has a structure in which a sheet of paperboard is subjected to shape processing and is folded. The paperboard is a sheet which is thicker and harder compared with a copy paper and so on. The spacer 1 has a thickness of 0.5 mm, for example.

The spacer 1 is assembled in such a manner that a paperboard 2 is cut into a shape shown in FIG. 5, this paperboard 2 is valley-folded along a plurality of dashed lines L1, and is mountain-folded along two dashed lines L2. The spacer (the above-described cut paperboard 2) includes a main body portion 2*a* of an approximately rectangular shape, and two rotation prevention pieces 2*b* that are belt-like portions. The respective rotation prevention pieces 2*b* extend in the directions to separate from the main body portion 2*a*, and symmetrically in the horizontal direction in FIG. 5, and are connected to the main body portion 2*a* via the dashed lines L1, respectively.

The main body portion 2*a* has two engagement pieces 3 which slightly project from the both end sides (sides where the rotation prevention pieces 2*b* are not connected to the main body portion 2*a*) in the longitudinal direction thereof, respectively. Further, the main body portion 2*a* has four slits S1, S2, S3, S4 at positions overlapping with the dashed lines L1, respectively. The slits S1-S4 are respectively provided so as to facilitate the folding of the main body portion 2*a* at the positions of the dashed lines L1.

Further, the main body portion 2*a* has three opening portions 4, 5, 6. In FIG. 5, the uppermost first opening portion 4 is a rectangular opening portion provided between the engagement piece 3 at the upper end shown in the drawing and the slit S1. The second opening portion 5 is an opening portion of an approximately rectangular shape which when the main body portion 2*a* is folded at the position of the slit S1, the opening portion 5 overlaps with the opening portion 4. The opening portion 5 has two fitting claws projecting inward at the centers thereof, respectively. The third opening portion 6 is provided between the two slits S2, S3 arranged at the centers of the main body portion 2*a*.

When the main body portion 2*a* is folded inward along the four dashed lines L1, the opening portions 4, 5 become overlapped with each other, and the two engagement pieces 3 which are located at the both ends of the main body portion 2*a* in the longitudinal direction are inserted through the central opening portion 6, and are engaged. Further, the two rotation prevention pieces 2*b* are folded in the above-described directions at the positions of the dashed lines L1, L2, and thereby the spacer 1 shown in FIG. 3 and FIG. 4 is assembled. That is, the spacer 1 has a structure which can be assembled without using adhesive agent or the like. The two rotation prevention pieces 2*b* prevent the rotation of the spacer 1, when the spacer 1 is attached to the conveying unit 40.

When the spacer 1 is assembled as described above, the opening portion 5 having two fitting claws 5*a* is located at the back surface side of the main body portion 2*a*, as shown in FIG. 4. In this state, the rectangular opening portion 4 overlapping with the opening portion 5 comes to overlap with the inside of the opening portion 5. The two fitting claws 5*a*, 5*b* become in the state that the fitting claws 5*a*, 5*b* are raised from the bottom surface (that is, the main body portion 2*a* between the slits S3, S4) of the opening portion 4, by the portion of the depth (the thickness of the paperboard 2) of the opening portion 6.

The spacer 1 assembled as described above is attached to the conveying unit 40 in the state so that an operator can easily access in the state that the conveying unit 40 is opened, as shown in FIG. 2. That is, the spacer 1 is attached to the conveying unit 40, in the state in which at the time of shipment of the MFP 10, an operator can easily attach the spacer 1, and at the time of using the MFP 10, a user (or an operator to install the MFP) can easily detach the spacer 1. Specifically, the spacer 1 is detachably attached to the contact roller 201 of the transfer unit 20 of the conveying unit 40.

Figure 6:
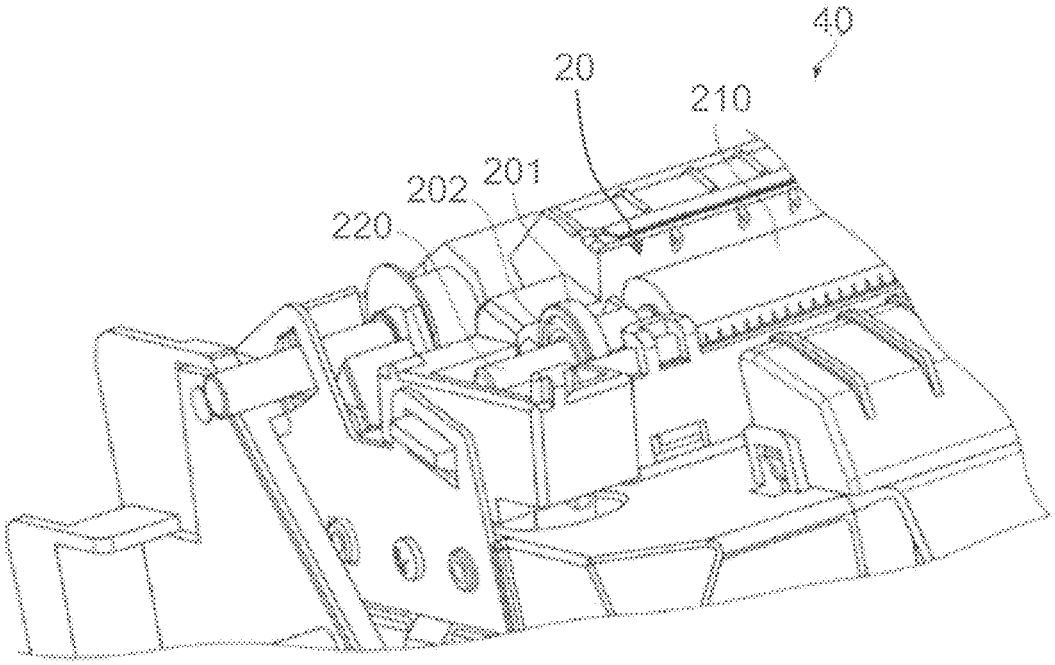
FIG. 6 is a perspective view showing by partially enlarging a main portion of the sheet conveying unit from which the spacer has been detached, in the state that the conveying unit doubling as the side face cover of the image forming apparatus according to the first embodiment is opened.
Figure 7:
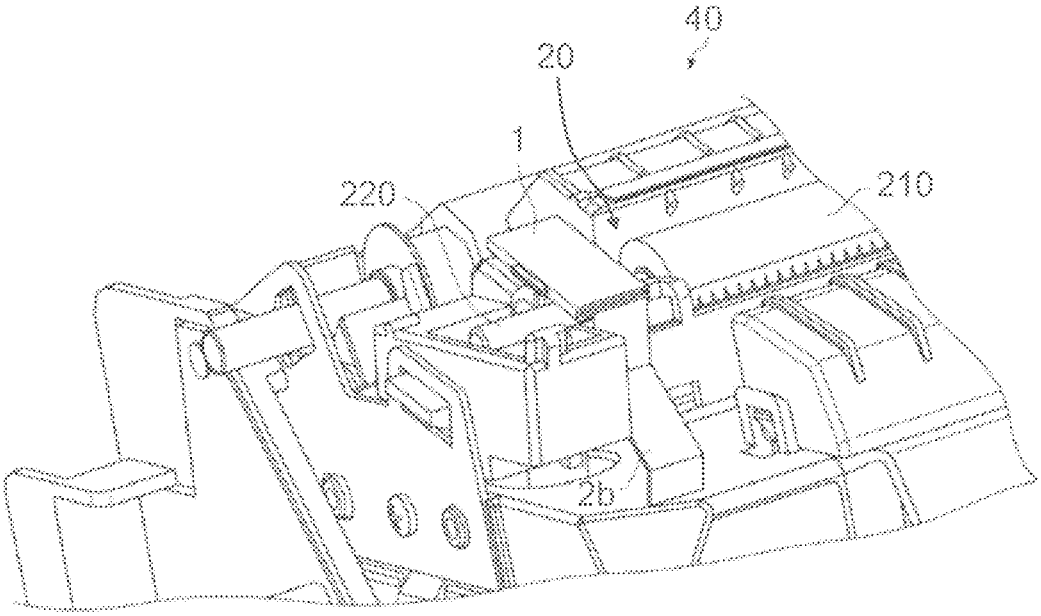
FIG. 7 is a perspective view showing a state in which the spacer is attached to the contact roller of the conveying unit of the image forming apparatus according to the first embodiment.
Figure 8:
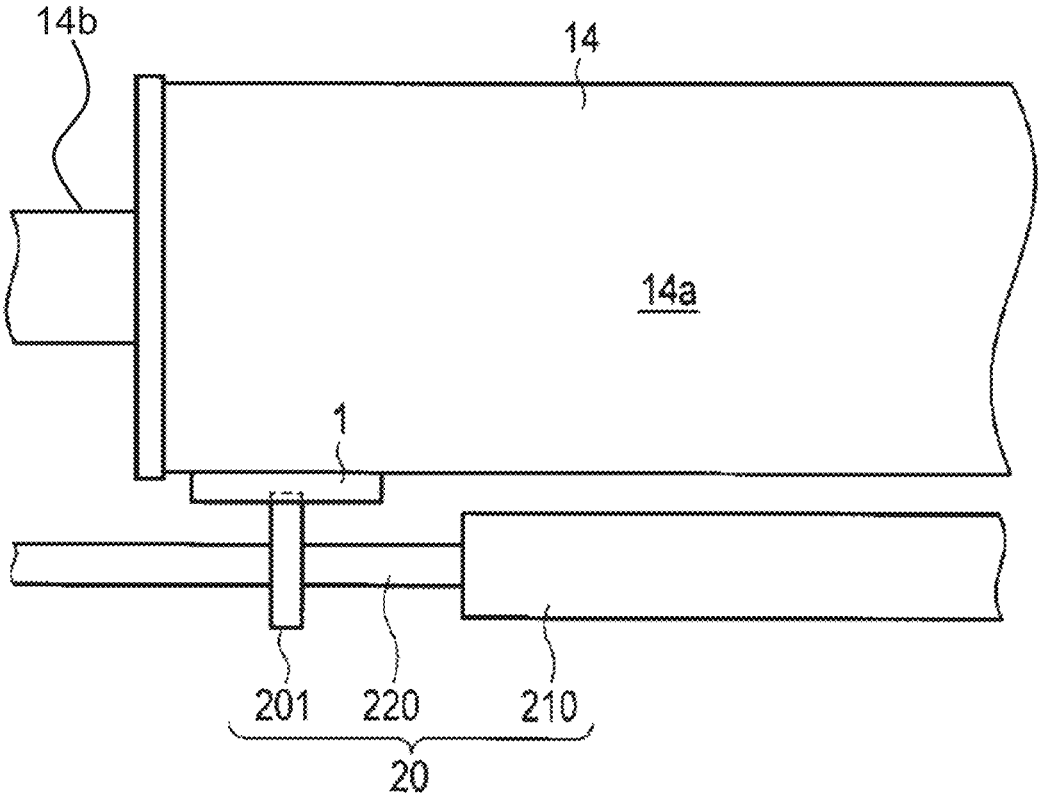
FIG. 8 is a diagram showing the relation between the spacer attached to the conveying unit of the image forming apparatus according to the first embodiment, and the transfer unit.
Figure 9:
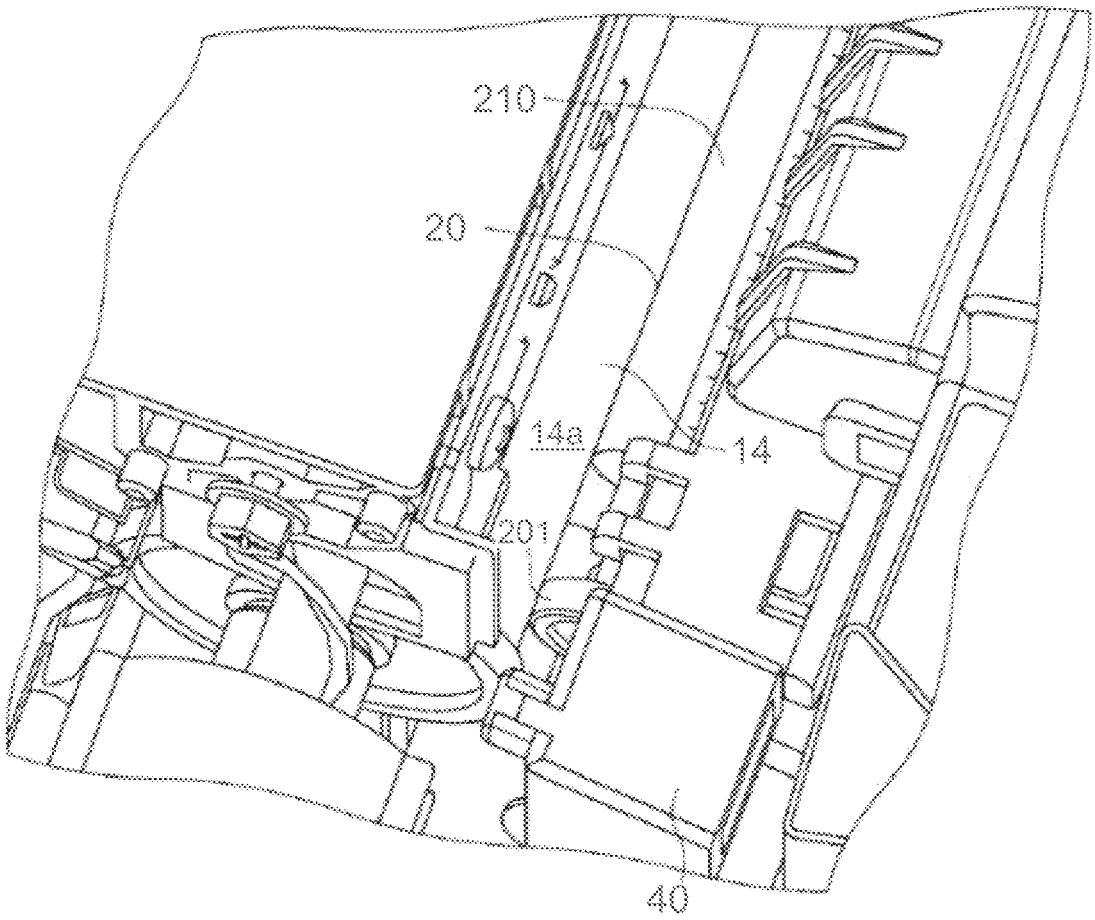
FIG. 9 is a perspective view showing the conveying unit from which the spacer has been detached, in the state that the conveying unit doubling as the side face cover of the image forming apparatus according to the first embodiment is opened.

The spacer 1 will be further described with reference to FIG. 6, FIG. 7 and FIG. 8. FIG. 6 is a perspective view showing by partially enlarging a main portion of the sheet conveying unit 40 in the state that the spacer 1 is detached, in the state that the conveying unit 40 doubling as the side face cover of the image forming apparatus is opened. FIG. 7 is a perspective view showing a state of the MFP 10 at the time of shipment in which the spacer is attached to the contact roller of the conveying unit 40. FIG. 8 is a schematic diagram showing a state of the MFP 10 at the time of shipment in which the spacer 1 is attached between the photoconductor drum 14 and the transfer unit 20. FIG. 9 is a perspective view showing a state of the MFP 10 at the time of using in which the spacer 1 is detached and the conveying unit 40 doubling as the side face cover is closed.

The transfer unit 20 has the above-described transfer roller 210 and contact roller 201, as shown in FIG. 9. As shown in FIG. 9, the transfer roller 210 is attached to a rotary shaft 220, and faces the inside of the image forming region of the photosurface 14*a*, when the conveying unit 40 is closed. When the spacer 1 is not attached to the contact roller 201 (at the time of using the MFP 10), the transfer roller 210 makes contact with the inside of the image forming region of the photosurface 14*a*, to form the nip as described above. The contact roller 201 is attached to the rotary shaft 220 coaxial with the transfer roller 210. When the spacer 1 is not attached to the contact roller 201, the contact roller 201 makes contact with a portion deviated from the image forming region of the photosurface 14*a*. The contact roller 201 makes contact with the surface of the photoconductor drum 14, to perform positioning of the transfer roller 210 for the photoconductor drum 14. The contact rollers 201 are provided at the both ends of the rotary shaft 220 of the transfer roller 210.

Each of the contact rollers 201 forms a gap (not shown) of about the thickness of one sheet of the sheet P, between the surface of the photoconductor drum 14 and the outer circumferential surface of the transfer roller 210 of the transfer unit 20, in the state that the contact roller 201 contacts with the surface of the photoconductor drum 14. In other words, the contact roller 201 has an outer diameter slightly larger than an outer diameter of the transfer roller 210.

The spacer 1 is attached to the contact roller 201 of the transfer unit 20, as shown in FIG. 7. The contact roller 201 has a ring-shaped groove 202 provided on the outer circumferential edge thereof. The spacer 1 has the two fitting claws 5*a* for being attached to the above-described contact roller 201. When the spacer 1 is attached to the contact roller 201 (at the time of shipment of the MFP 10), the two fitting claws 5*a* of the spacer 1 are fitted in the above-described ring-shaped groove 202. Conversely, when the spacer 1 is detached from the contact roller 201, the spacer 1 is slightly strongly pulled, and thereby the spacer 1 can easily be detached.

In the state that the spacer 1 is attached to the contact roller 201, the two rotation prevention pieces 2*b* extend in the circumferential directions of the contact roller 201, and the tips of the two rotation prevention pieces 2*b* make contact with the insides of the conveying unit 40, respectively. In this contact state, the two rotation prevention pieces 2*b* prevent the main body portion 2*a* of the spacer 1 from rotating in the circumferential directions of the above-described contact roller 201.

When the conveying unit 40 is closed, after the spacer 1 has been attached to the contact roller 201, the main body portion 2*a* of the spacer 1 makes contact with the surface of the photoconductor drum 14, as shown in FIG. 8. The spacer 1 contacting with the photoconductor drum 14 is interposed between the contact roller 201 and the photoconductor drum 14, and thereby the contact roller 201 is separated from the photoconductor drum 14 by the thickness of the spacer 1. By this means, the transfer roller 210 of the transfer unit 20 provided coaxially with the contact roller 201 becomes in the state separated from the surface of the photoconductor drum 14.

A rotary shaft 14*b* of the photoconductor drum 14 and the rotary shaft 220 of the transfer roller 210 shown in FIG. 8 are slightly movably supported. Accordingly, when a gap is formed between the photosurface 14*a* of the photoconductor drum 14 and the transfer roller 210 by the interposition of the above-described spacer 1, the rotary shaft 14*b* and the rotary shaft 220 move in the directions to slightly separate from each other. In other words, the photoconductor drum 14 and the transfer roller 210 of the transfer unit 20 are supported slightly movably in the directions orthogonal to the axial directions by the rotary shafts 14*b*, 220, respectively. With this support structure, the conveying unit 40 can be closed in the state that the spacer 1 is attached.

According to the above-described embodiment, the image forming apparatus (the MFP 10) has the spacer 1 which is to be attached between the photoconductor drum 14 and the contact roller 201 of the transfer unit 20. Accordingly, even when the low temperature toner is used in the image forming apparatus, there is no anxiety that the low temperature toner firmly attaches to the photosurface 14*a* of the photoconductor drum 14 at the time of shipment of the image forming apparatus, and thereby it becomes possible to perform good image forming at the time of using the image forming apparatus.

In the above-described embodiment, the case that the spacer 1 is formed using a paperboard has been described, but without being limited to this, the spacer 1 may be formed by molding resin. When the spacer 1 is to be formed by molding resin, it is preferable to use a 3D printer or the like for forming the fitting claws 5*a*, 5*a*.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or corrections as would fall within the scope and spirit of the inventions.

What is claimed is:

1. An image forming apparatus comprising:

a case having a door which can be opened and closed;

a first rotating body, provided in the case, that is exposed from the case when the door is opened, the first rotating body including an image carrier having a toner image carrying surface;

a second rotating body, provided in the case, that is exposed from the case when the door is opened, the second rotating body forming a nip with the first rotating body, the second rotating body being a transfer roller that transfers a toner image from the toner image carrying surface to a recording medium, the transfer roller forming a nip with the toner image carrying surface;

a spacer, detachably provided in the case, that separates the first rotating body and the second rotating body when the spacer is attached, and wherein the second rotating body forms a nip with the first rotating body when the spacer is detached; and a contact roller provided coaxially with the transfer roller, wherein the spacer is detachably attached to the contact roller, and the contact roller is attached at the both ends of a rotary shaft of the transfer roller.

2. The image forming apparatus according to claim 1, wherein the contact roller performs positioning of the transfer roller for the image carrier when the spacer is detached from the contact roller.

3. The image forming apparatus according to claim 1, wherein the contact roller forms a gap of about the thickness of one of the recording medium between the toner image carrying surface of the image carrier and the outer circumferential surface of the transfer roller when the spacer is detached from the contact roller.

4. The image forming apparatus according to claim 1, wherein the contact roller has an outer diameter slightly larger than an outer diameter of the transfer roller.

5. An image forming apparatus comprising:

a case having a door which can be opened and closed;

a first rotating body, provided in the case, that is exposed from the case when the door is opened, the first rotating body including an image carrier having a toner image carrying surface;

a second rotating body, provided in the case, that is exposed from the case when the door is opened, the second rotating body forming a nip with the first rotating body, the second rotating body being a transfer roller that transfers a toner image from the toner image carrying surface to a recording medium;

a spacer, detachably provided in the case, that separates the first rotating body and the second rotating body when the spacer is attached, the second rotating body forming a nip with the first rotating body when the spacer is detached; and a contact roller provided coaxially with the transfer roller, the spacer being detachably attached to the contact roller, wherein the transfer roller forms the nip with the toner image carrying surface within an image forming region of the toner image carrying surface where the toner image is formed when the spacer is detached from the contact roller.

6. The image forming apparatus according to claim 5, wherein the contact roller contacts the toner image carrying surface outside of the image forming region of the toner image carrying surface when the spacer is detached from the contact roller.

7. The image forming apparatus according to claim 6, wherein the spacer is detachably attached to the contact roller, and is interposed between the image carrier and the contact roller.

8. An image forming apparatus comprising:

a case having a door which can be opened and closed;

a first rotating body, provided in the case, that is exposed from the case when the door is opened;

a second rotating body, provided in the case, that is exposed from the case when the door is opened, the second rotating body forming a nip with the first rotating body;

a spacer, detachably provided in the case, that separates the first rotating body and the second rotating body when the spacer is attached, wherein the second rotating body forms a nip with the first rotating body when the spacer is detached; and a contact roller provided coaxially with the second rotating body, wherein the spacer is detachably attached to the contact roller.

9. The image forming apparatus according to claim 8, wherein the contact roller performs positioning of the second rotating body for the first rotating body when the spacer is detached from the contact roller.

10. The image forming apparatus according to claim 8, wherein the contact roller is attached at the both ends of a rotary shaft of the second rotating body.

11. The image forming apparatus according to claim 10, wherein the contact roller has an outer diameter slightly larger than an outer diameter of second rotating body.

12. The image forming apparatus according to claim 8, wherein the contact roller forms a gap of about the thickness of one of a recording medium between a surface of the first rotating body and a surface of the second rotating body when the spacer is detached from the contact roller.

13. The image forming apparatus according to claim 8, wherein the spacer is detachably attached to the contact roller, and is interposed between the image carrier and the contact roller.

* * * * *